US006192971B1

(12) United States Patent
Girardin et al.

(10) Patent No.: US 6,192,971 B1
(45) Date of Patent: Feb. 27, 2001

(54) CLAMPING DEVICE FOR A POURING TABLE IN A MACHINE FOR THE CONTINUOUS VERTICAL CASTING OF CAST IRON TUBES

(75) Inventors: Denis Girardin, Maidieres; Fabien Arnould, Pont-A-Mousson; Yvan Morcel, Viterne, all of (FR)

(73) Assignee: Pont-A-Mousson, Cedex (FR)

( * ) Notice: Subject to any disclaimer, the term of this patent is extended or adjusted under 35 U.S.C. 154(b) by 0 days.

(21) Appl. No.: 09/202,952

(22) PCT Filed: Jul. 11, 1997

(86) PCT No.: PCT/FR97/01300

§ 371 Date: Jun. 24, 1999

§ 102(e) Date: Jun. 24, 1999

(87) PCT Pub. No.: WO98/03289

PCT Pub. Date: Jan. 29, 1998

(30) Foreign Application Priority Data

Jul. 17, 1996 (FR) ..... 96 08960

(51) Int. Cl.[7] ..... B22D 11/14
(52) U.S. Cl. ..... 164/421; 164/464; 164/484
(58) Field of Search ..... 164/421, 464, 164/465, 483, 484

(56) References Cited

U.S. PATENT DOCUMENTS 4,506,723 * 3/1985 Bellocci et al. ..... 164/421
4,611,651 * 9/1986 Gourmel et al. ..... 164/421 X
4,690,199 * 9/1987 Gourmel et al. ..... 164/421

FOREIGN PATENT DOCUMENTS 1 357 949 7/1964 (FR) .
WO 94/26444 11/1994 (WO) .

* cited by examiner

*Primary Examiner*—J. Reed Batten, Jr.
(74) *Attorney, Agent, or Firm*—Sughrue, Mion, Zinn, Macpeak & Seas, PLLC

(57) ABSTRACT

A sealing device for a casting table of a machine for the continuous vertical casting along a vertical extraction axis (X—X) of cast iron pipes (T) includes a die block (5) aligned with the vertical extraction axis and a device (3) for the supply of liquid iron. Two sealing gaskets (12A, 12B) are located between the outlet from the device supplying liquid iron and the entry to the die block. The sealing device has members (6, 15, 21) for tightening the die block against the outlet of the supply device, parallel to the vertical extraction axis, in order to tighten the sealing gaskets.

6 Claims, 3 Drawing Sheets

CLAMPING DEVICE FOR A POURING TABLE IN A MACHINE FOR THE CONTINUOUS VERTICAL CASTING OF CAST IRON TUBES

BACKGROUND OF THE INVENTION

This invention relates to the casting of molten metals, and more particularly the continuous vertical casting of metal parts, in particular pipes, of cast iron. Although it applies to the casting of different types of metal parts, it is particularly advantageous for the casting of thin-walled cast iron pipes. The expression "thin-walled pipes" applies to pipes of small thickness/diameter ratio, less than 10%, rather than the thickness considered by itself in isolation.

The invention relates more particularly to a machine for the continuous vertical casting along a vertical extraction axis of cast iron pipes comprising a die block aligned with the vertical extraction axis and a device for the supply of liquid iron feeding the die, a machine in which at least one sealing gasket is located between the outlet from the supply device and the inlet to the die.

In order to ensure a satisfactory seal at the gasket or gaskets it is necessary to apply a certain tightening force to them parallel to the axis of extraction of the pipes. This force should act against the force extracting the pipes in order to compress the sealing gaskets and thus ensure a seal for the whole.

When a casting machine is brought up to steady state conditions, the various materials in contact with the liquid metal expand by different proportions according to the material. This expansion affects the tightening of the sealing gaskets, so the gaskets can be damaged and/or the seal for the liquid metal may be lost.

Difficulties of the same kind may result from creep of the gaskets over time, and also their adhesion to the pipe die during the course of manufacture.

SUMMARY OF THE INVENTION

The purpose of this invention is to overcome these various disadvantages by providing a casting machine in which a seal for the liquid metal is ensured during both the stage during which steady state conditions are attained and the stage of operation at constant high temperature.

In order to achieve this the invention relates to a sealing device for a casting table of a machine for the continuous vertical casting along a vertical extraction axis of parts, in particular pipes, of cast iron, the casting table comprising a die block which is aligned with the vertical extraction axis and also a device for supply of liquid iron feeding the die block, at least one sealing gasket being located between the outlet of the device supplying liquid iron and the die block, characterised in that it comprises means for tightening the die block against the device for the supply of liquid metal with a constant force, parallel to the vertical extraction axis, in order to tighten the sealing gaskets.

The sealing device for the casting table of the casting machine according to the invention may incorporate one or more of the following features:

the tightening means comprise a support for the die block which can be moved along an axis substantially parallel to the vertical extraction axis, a frame on which the device for the supply of cast iron is mounted, and at least two fluid-operated jacks regularly distributed around the die block, each jack being attached to both the said support and the said frame, and each jack being connected by means of a fluid conduit to a unit controlling the tightening force from each jack, the fluid conduits for the jacks are joined together into a common fluid conduit, and this common conduit is connected to the unit governing the tightening force.

the fluid-operated jacks are hydraulic jacks, the fluid-operated jacks are pneumatic jacks, the bodies of the jacks are entirely located outside the space between the two horizontal planes bounding the induction coils.

The invention also relates to a casting table for a machine for the continuous vertical casting of parts, in particular pipes, of cast iron along a vertical extraction axis (X—X), the casting table comprising a die block aligned along the vertical extraction axis (X—X) and also a device for the supply of liquid iron feeding the die block, at least one sealing gasket being located between the outlet from the device for the supply of liquid iron and the die block, characterised in that it comprises a sealing device as defined above.

BRIEF DESCRIPTION OF THE FIGURES

Other features and advantages of the invention will become apparent from the following description which is given by way of a non-restrictive example with reference to the appended drawings in which.

DETAILED DESCRIPTION OF THE PREFERRED EMBODIMENT

Figure 1:
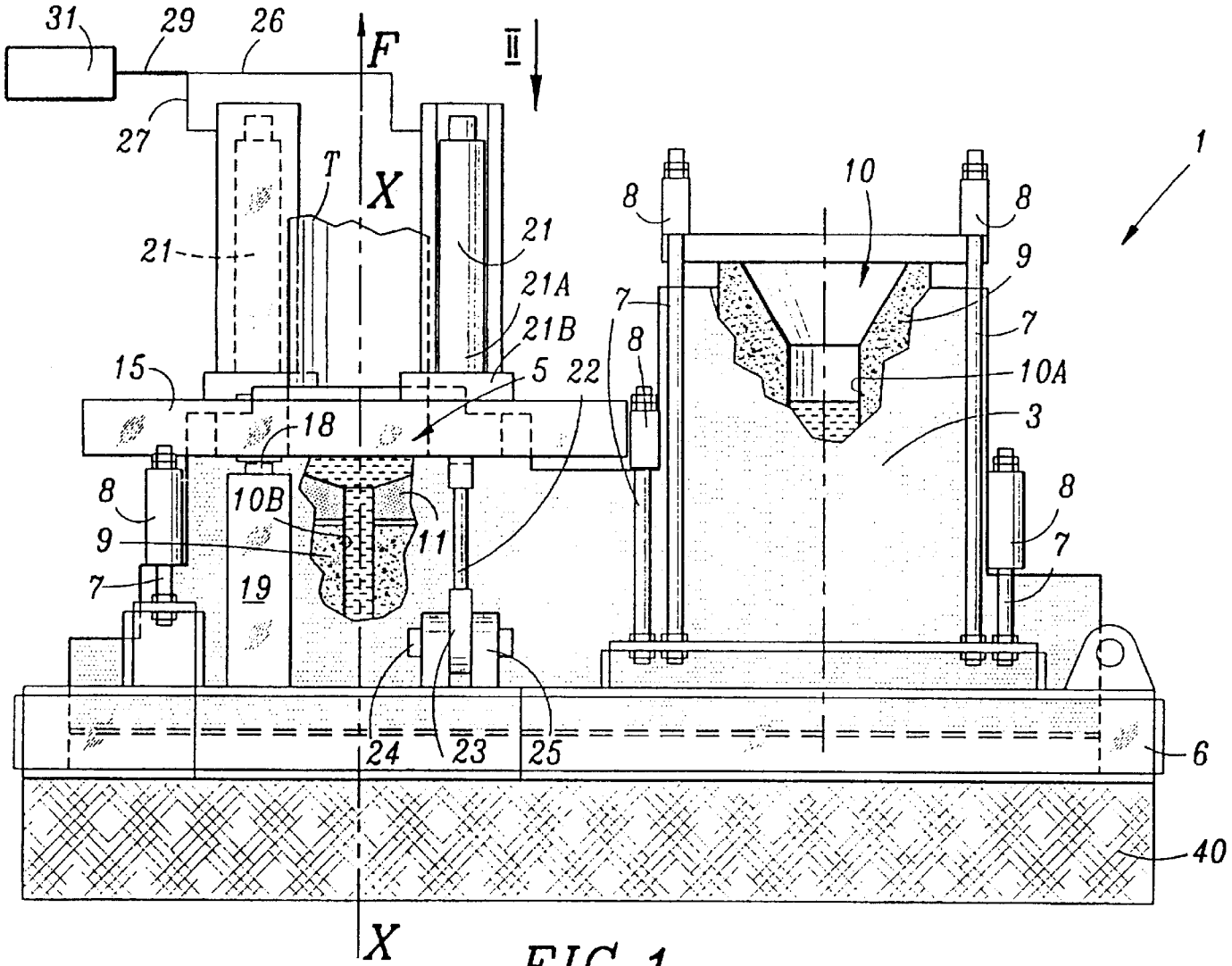
FIG. 1 is a view from the side of a casting table according to the invention with a first cut-out at the inlet to the device for the supply of liquid iron and a second at the outlet from that device.

FIG. 1 shows a table 1 for the continuous vertical ascendant casting of parts, in particular pipes T, of cast iron. This casting device incorporates a device 3 for the supply of liquid iron and a die block 5 which is fed via its lower end by this supply device 3. Pipe T is drawn out from die block 5 by extraction means which are not shown, in an upward direction along vertical extraction axis X—X. The direction of the extraction force is represented by an arrow F.

Device 3 for the supply of liquid iron is set on a frame 6 and prevented from making lateral and vertical movements thereon by vertical tie bars 7 and horizontal cross-members 8. It incorporates a U-shaped siphon 9 which is constructed from cast refractory concrete in a single piece.

This siphon 9 incorporates a conduit 10 for the supply of liquid iron comprising a vertical descending part 10A through which the molten iron enters, a horizontal part (not shown in the figures) and a vertical part 10B through which the liquid iron departs, which is directed upwards.

Figure 3:
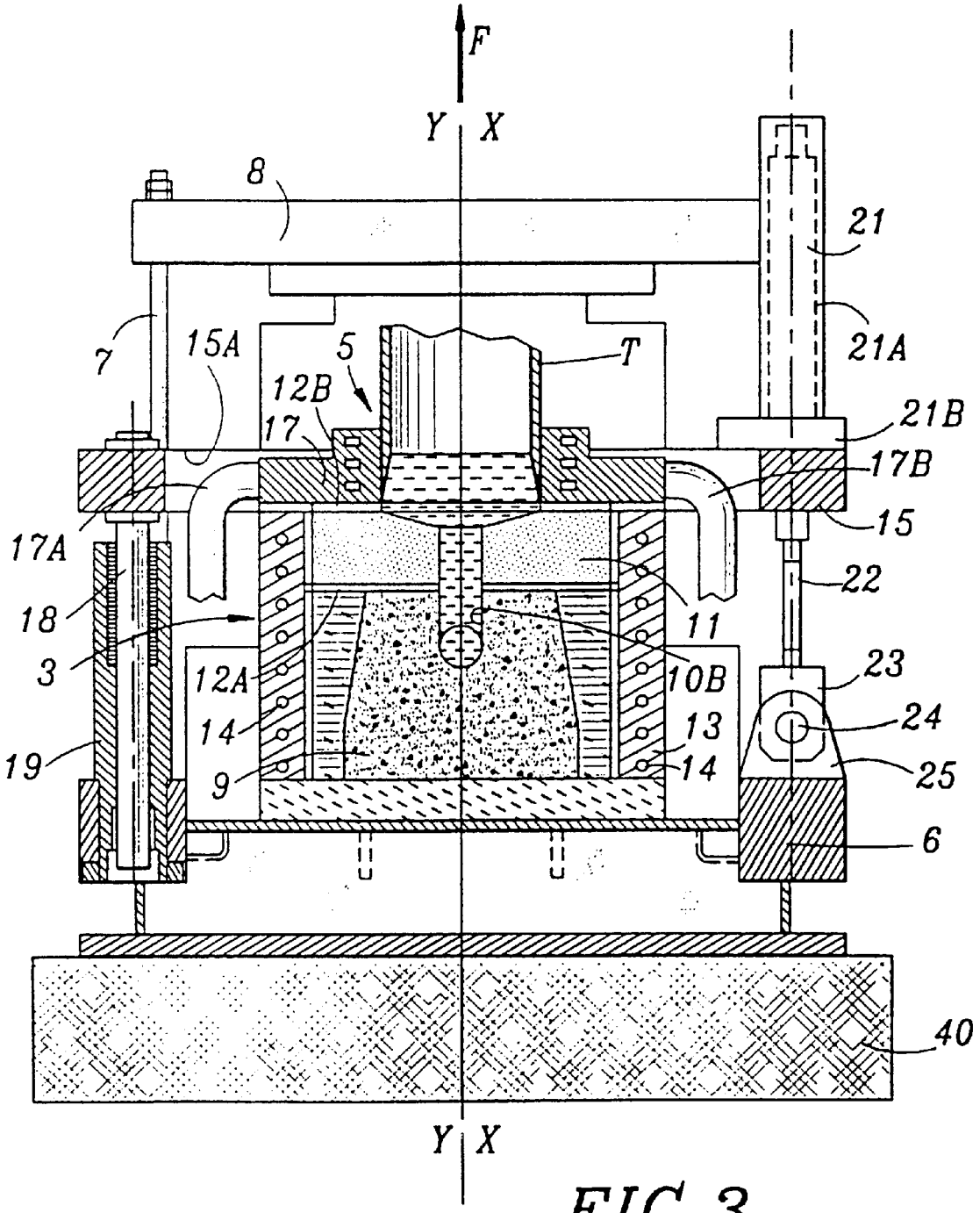
FIG. 3 is a view in transverse cross-section along the line III—III in FIG. 2.

With reference in particular to FIG. 3, it will be seen that a heating base 11 is placed between die block 5 and the outlet from siphon 9. The seal for the molten metal is provided by two annular sealing gaskets 12A and 12B, a first one 12A located between the outlet from siphon 9 and the underside of heating base 11, and a second 12B located between the upper surface of heating base 11 and the underside of die block 5.

In addition to this, siphon 9 and heating base 11 are surrounded by a shell 13 in the thickness of which induction coils 14 are embedded. These induction coils 14 are provided with electrical current by an external current generator, which is not shown, to keep the iron molten through induction beating.

Die block 5 is fixedly mounted in a retractable support 15 in the form of a platen. This die block incorporates a cooling unit 17, which is connected to a cooling fluid circuit by means of inlet pipe 17A and outlet pipe 17B. Unit 17 has an extension of reduced diameter on its upper surface. This is housed in a matching housing 15A in support 15 which has a vertical axis Y—Y and is attached thereto by means of a crown of axial bolts 15B (FIG. 2).

Figure 2:
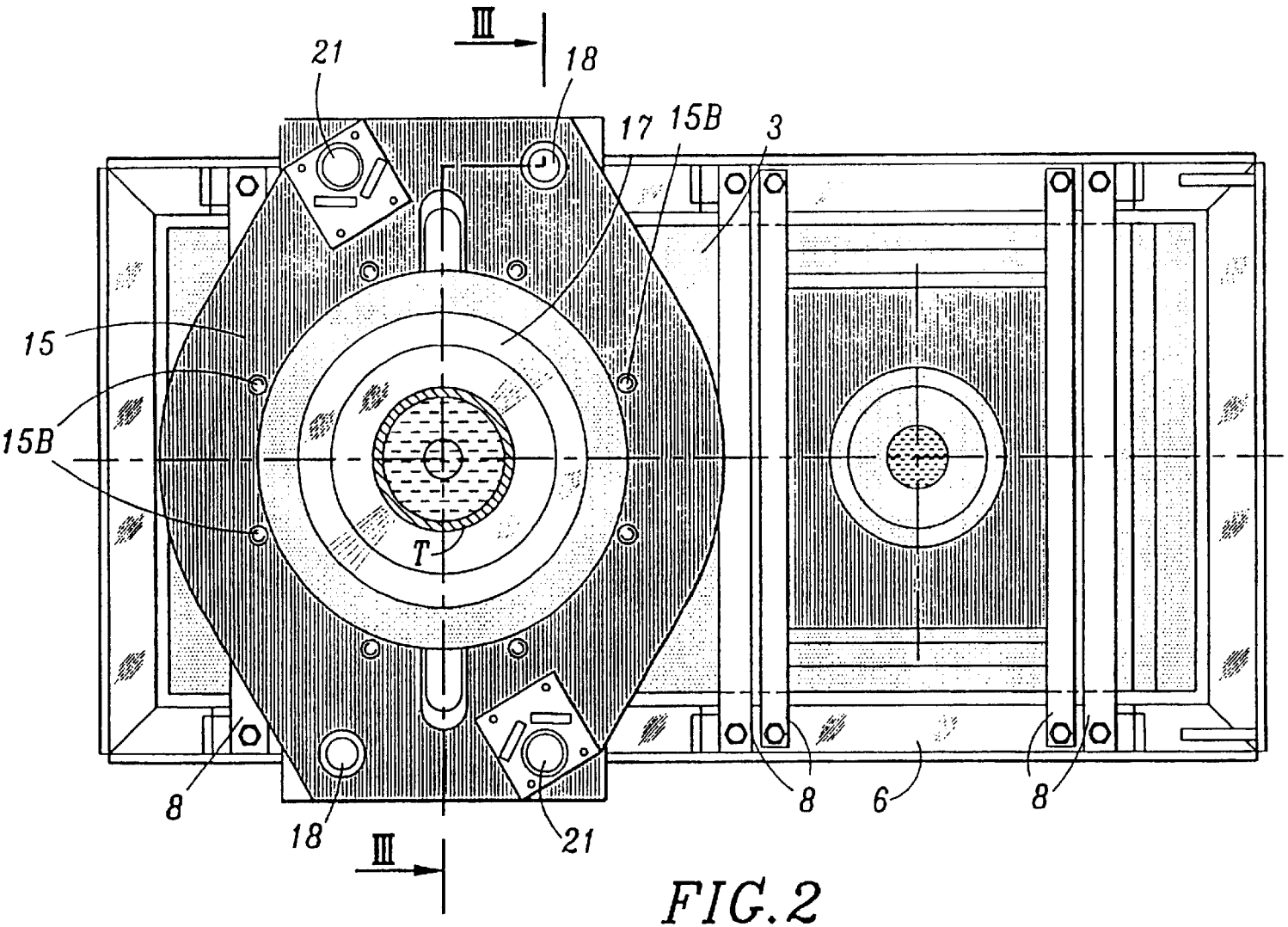
FIG. 2 is a view of the casting table from above, in the direction of arrow II in FIG. 1.

The relative position of support 15 with respect to frame 6 is determined by two short columns 18 which are directed downwards and are attached to support 15 in a diametrically opposite fashion with respect to die block 5, as shown in FIG. 2. FIG. 3 shows that each short column 18 is guided into an associated socket 19 with ball-bearings, which is fixed to frame 6.

As a result of the use of short columns 18 acting together with ball-bearing sockets 19, the relative position of support 15 with respect to frame 6 and therefore the relative position of die block 5 with respect to frame 6 are precisely defined in a plane perpendicular to vertical extraction axis X—X, while the distance between the support and the frame can be adjusted parallel to axis X—X.

In order to immobilise the position of support 15 along axis X—X with respect to frame 6, two fluid-operated jacks 21, such as e.g. hydraulic jacks or pneumatic jacks, are fixed in diametrically opposite positions on support 15 (FIG. 2). As shown in FIG. 3, each jack 21 comprises a rod 22 whose free end 23 is secured by a gudgeon 24 in a mounting 25 which is integral with frame 6. Each gudgeon 24 is secured in mounting 25 by pins (not shown) so that support 15 can be easily dismantled from frame 6. The bodies 21A of jacks 21 are fixed to the upper surface of platen 15 by means of a collar 21B in order to be outside the reach of the induction field generated by induction coils 14.

As may be seen in FIG. 1, each fluid-operated jack 21 is connected by means of a conduit 26, 27 to a common conduit 29. This common conduit 29 is connected to a hydraulic unit 31 regulating the tightening force of each jack, which is shown diagrammatically. Advantageously, this hydraulic unit is also mounted on frame 6.

Once the position of support 15 with respect to frame 6 has been immobilised by jacks 21, the support and the frame, together with die block 5 and supply device 3, form a rigid integral assembly. This rigid integral assembly rests on a fixed base 40.

In order to tighten sealing gaskets 12A and 12B a particular tightening force is applied to the jacks by means of regulating unit 31. The tightening force exerted on sealing gaskets 12A and 12B corresponds to the tightening force exerted by jacks 21 to draw mountings 25 in the direction of support 15. Given the fact that two jacks connected to hydraulic unit 31 by a common conduit 29 are used, the tightening force applied is identical for each jack. In addition to this, once adjusted, it remains constant despite the expansion which takes place in heating base 11, and despite creep in the gaskets and adhesion between pipe T and the die, on account of the hydraulic principle of its operation.

In addition to this the provision of tightening by means of hydraulic jacks also performs the function of a "safety fuse". In fact, when the force extracting pipe T becomes greater than the force applied to the jacks, the components of the die block tend to come apart in the direction in which pipe T is extracted. This brings about release of the gaskets and the leakage of metal to the exterior, and the machine stops without damage to the installation for the manufacture of pipes.

What is claimed is:

1. A sealing device for a casting table of a machine for a continuous ascending vertical casting along a vertical extraction axis (X—X) of cast iron pipes (T), the casting table comprising:

a die block (5) aligned with the vertical extraction axis, a device (3) for supplying liquid iron to the die block and, at least one sealing gasket (12A; 12B) disposed between an outlet from the supplying device and the die block, and the sealing device comprising means (15, 6, 21) for tightening the die block against the outlet of the supplying device with a constant and uniformly applied force, parallel to the vertical extraction axis to compress the at least one sealing gasket, said force acting in a direction opposite the ascending direction of pipe extraction.

2. A sealing device for a casting table of a machine according to claim 1, wherein the tightening means comprise a support (15) for the die block which can be moved along an axis substantially parallel to the vertical extraction axis, a frame (6) on which the device for supplying liquid iron rests, and at least two fluid-operated jacks (21), uniformly distributed around the die block, each jack being connected to both the support and the frame (6), and each jack being connected by an associated fluid conduit (26, 27) to a unit (31) regulating the tightening force in each jack.

3. A sealing device for a casting table of a machine according to claim 2, wherein fluid conduits are connected to a common fluid conduit (29) in turn (29) is connected to the unit regulating the tightening force.

4. A sealing device for a casting table of a machine according to claim 2 wherein the fluid-operated jacks are hydraulic jacks.

5. A sealing device for a casting table of a machine according to claim 2 wherein the fluid-operated jacks are pneumatic jacks.

6. A sealing device for a casting table of a machine according to claim 2 wherein bodies of the jacks are located outside a space lying between two horizontal planes which bound induction coils (14).

* * * * *